US005934472A

United States Patent [19]

Ramirez et al.

[11] Patent Number: 5,934,472

[45] Date of Patent: Aug. 10, 1999

[54] PROCESSOR TRAY

[75] Inventors: Richard L. Ramirez, Lawrenceville; Mark A. Bergeron, Lithonia, both of Ga.

[73] Assignee: Tekni-Plex, Inc., Somerville, N.J.

[21] Appl. No.: 09/056,025

[22] Filed: Apr. 6, 1998

[51] Int. Cl.[6] ..... B65D 1/34

[52] U.S. Cl. ..... 206/557; 229/407; 220/574; 220/659; 426/129

[58] Field of Search ..... 206/518, 557, 206/564; 220/574, 659, 900, 902; 229/407; D9/425, 432; 426/129

[56] References Cited

U.S. PATENT DOCUMENTS

| | | | |
|---|---|---|---|
| D. 223,657 | 5/1972 | Reifers . | |
| D. 276,216 | 11/1984 | Michaud | D9/425 |
| D. 392,884 | 3/1998 | Hayes | D9/432 |
| 2,975,931 | 6/1961 | Harrison . | |
| 3,092,246 | 6/1963 | Harrison et al. . | |
| 3,185,371 | 5/1965 | Reifers . | |
| 3,468,468 | 9/1969 | Foote . | |
| 3,682,365 | 8/1972 | Reifers et al. | 229/407 |
| 3,700,096 | 12/1972 | Reifers . | |
| 3,703,383 | 11/1972 | Kuchenbecker . | |
| 4,058,247 | 11/1977 | Florian . | |
| 4,221,320 | 9/1980 | Faller . | |
| 4,623,088 | 11/1986 | Holden . | |
| 4,856,393 | 8/1989 | Braddon . | |
| 4,856,704 | 8/1989 | Tolson et al. . | |
| 5,018,623 | 5/1991 | Hrenyo . | |
| 5,050,791 | 9/1991 | Bowden et al. | 229/407 |
| 5,265,756 | 11/1993 | Meier et al. . | |
| 5,335,787 | 8/1994 | Finchum et al. | 206/564 |
| 5,503,858 | 4/1996 | Reskow . | |

*Primary Examiner*—David T. Fidei
*Attorney, Agent, or Firm*—Anthony J. Casella; Gerald E. Hespos; Ludomir A. Budzyn

[57] ABSTRACT

A processor tray is provide for maintaining plastic film wrapped thereabout in a taut state. The tray is unitarially formed with a plurality of sidewalls, a comer joining each pair of sidewalls, and a base. A flange is formed to extend outwardly and downwardly from uppermost portions of the sidewalls and the corners preferably in the range of 15°–35°. Additionally, the flange may be formed with varying widths about the perimeter of the tray. The base may be either formed flat or, alternatively, the base may be formed with three concentric regions to define a concavity, with one region being planar and raised relative to the bottom of the tray.

38 Claims, 5 Drawing Sheets

PROCESSOR TRAY

BACKGROUND OF THE INVENTION

1. Field of the Invention

The invention relates to plastic foam packaging and, more particularly, plastic foam processor trays for packaging perishable foods, fragile objects, and the like.

2. Description of the Prior Art

Various plastic foam tray designs are known in the prior art. In preparing a processor tray design, inner surface area, capacity, sidewall rigidity, and weight are key considerations. A well-received prior art processor tray design which provides for these considerations is disclosed in U.S. Pat. No. 5,018,623 to Hrenyo, owned by the assignee hereof, which includes outwardly bowed sidewalls having a bead integrally formed thereon; the Hrenyo tray is formed such that upon application of plastic film wrap to the tray, the wrapped tray is formed with straight sidewalls.

Although the processor tray of U.S. Pat. No. 5,018,623 has met considerable commercial success, improvements in maintaining the surrounding plastic film overwrap in a tight seal with the tray are always desired. A shortcoming of the prior art lies in the inadequacy of the prior art to maintain surrounding plastic film, which is either stretch-wrapped or shrink-wrapped about the tray and packaged goods, in a taut state. Specifically, once a wrapped tray is packaged and wrapped and is case ready, it is placed into a master container for shipment. In the master container, the packaged and wrapped processor trays are stacked upon one another and the weight of the packaged processor trays causes the plastic film of underlying trays to be stretched and loosened during shipment. Consequently, the packaged trays leak juices, blood, etc. from the products packaged therein. Moreover, several prior art trays are insufficiently rigid to maintain their respective desired shapes when continuously subjected to the pressure of wrapped plastic film. Such tray designs eventually warp with the plastic film becoming loosened, or the trays fail in extreme cases.

It is an object of the subject invention to provide a processor tray which can maintain plastic film wrapped thereabout in a taut state.

It is also an object of the subject invention to provide a processor tray having substantial sidewall rigidity provided by an outwardly and downwardly extending flange which is formed with varying widths.

It is further an object of the subject invention to provide a processor tray with a base having a raised rectangular portion centrally located to extend through the bottom of the base.

SUMMARY OF THE INVENTION

The aforementioned objects are met by a plastic foam processor tray having a base, four sidewalls, and four corners, each comer being located between adjoining sidewalls. The base, sidewalls and corners are integrally and continuously formed without interruptions to define a smooth inner surface of the tray and a volume for accommodating the goods to be packaged therein. The base is also formed to define a planar bottom for supporting the tray.

A flange is integrally formed with the sidewalls and the corners which extends from uppermost portions thereof in outward and downward directions. Preferably, at least one surface of the flange is formed to define an acute angle relative to the plane of the tray bottom in the range of 15°–35°. Additionally, the flange is preferably formed with a non-constant width, wherein the width of the flange at mid-points of the sidewalls is greater than the width of the flange located at the corners. The flange advantageously provides spring force which maintains wrapped plastic film in a taut state. Also, the flange provides additional rigidity to the corners and the sidewalls of the tray.

Also, preferably, the sidewalls are disposed at an acute angle in the range of 15°–40° relative to a vertical reference axis. The corners, however, are formed to be further sloped outwardly than the sidewalls, with the corners being generated at an acute angle preferably in the range of 19°–45°. A bead, continuous or interrupted, may be formed on the sidewalls and/or the corners.

The base may be formed to define a concavity extending into the bottom surface of the base which is defined by three regions: a perimeter region; a raised planar central region; and regions which continuously extend between the perimeter and the raised region. Alternatively, the base may be formed flat. Advantageously, the tray design can be adapted to accommodate preferences relating to plastic film wrapping of the tray. Individuals have indicated a preference of the tray base shape based on the plastic film wrapping technique which is to be used—e.g., a preference for flat-bottomed trays has been indicated with regard to specific heating or cooling sealing machines for shrink- or stretch-wrapping.

Finally, the sidewalls may be either formed with bow-out curvature, such as that shown in U.S. Pat. No. 5,018,623, bow-in curvature, or a combination of both.

These and other features of the invention will be better understood through a study of the following detailed description and accompanying drawings.

DETAILED DESCRIPTION OF THE INVFNTION

Figure 1:
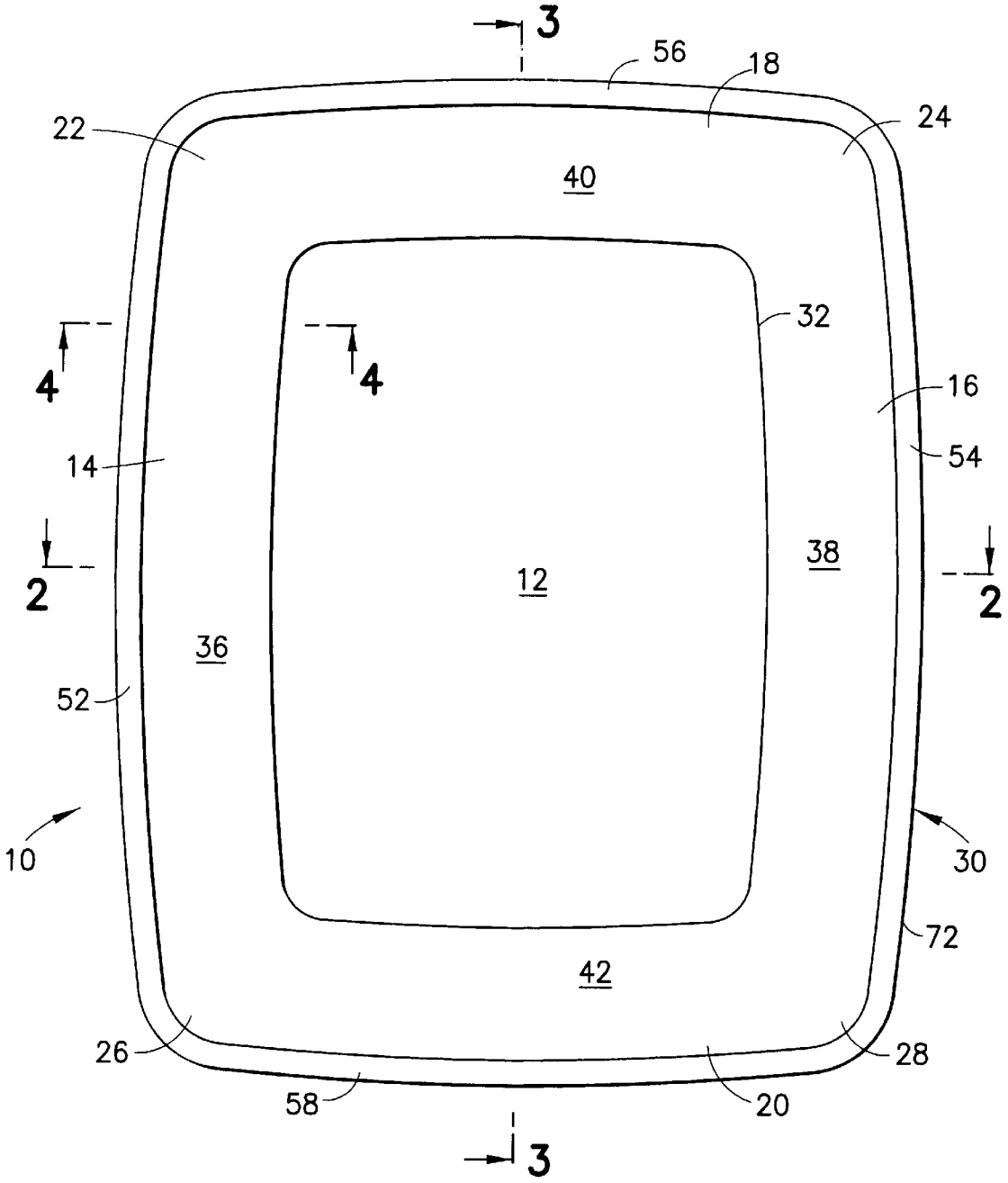
FIG. 1 is a top plan view of the first embodiment of the invention.

Referring generally to FIGS. 1–4, a first embodiment of the processor tray of the invention is depicted therein and generally designated with the numeral 10. The tray 10 is formed of a plastic foam material, such as foamed polystyrene or expanded polystyrene, and includes a base 12, longitudinal sidewalls 14, 16, end sidewalls 18, 20 and corners 22–28. Additionally, the tray 10 may be lined or coated with barrier film. A flange 30 is formed to extend from uppermost portions of the sidewalls 14–20 and the corners 22–28. The die-cutting method disclosed in U.S. Pat. No. 4,856,393 to Braddon is preferably used in forming the tray 10.

The tray 10 is shown in the FIGS. to have a generally rectangular shape, with the longitudinal sidewalls 14, 16 being longer in length than the end sidewalls 18,20. The tray 10, however, can be formed with other shapes; for example, the sidewalls 14–20 could each be formed with equal lengths resulting in the tray 10 having a generally square appearance, or, the sidewalls 14–20 may be formed with more curvature thus giving the tray 10 a generally elliptical appearance. It should be noted that the shape of the tray 10 is not essential to practicing the invention as described below.

The base 12, in the first embodiment, is generally flat, with an interior surface 29 and a planar bottom 31. Alternatively, the base 12 may be formed with a central raised portion in the manner described below. A perimeter 32 extends about the base 12. The sidewalls 14–20 and the corners 22–28 are integrally formed with and extend from the perimeter 32 in upward directions from the base 12. To facilitate stacking of the tray 10, the sidewalls 14–20 and the corners 22–28 are joined to the base 12 along a rounded base comer 34 which extends about the perimeter 32. Although the perimeter 32 is represented in FIG. 1 by a distinct line, the representation is intended only for clarity. In viewing a physical embodiment of the tray 10, a clear demarcation of the perimeter 32 is not present due to the smooth blending of the sidewalls 14–20 and the corners 22–28 through the base corner 34 with the base 12.

The sidewalls 14–20 are angularly disposed relative to the base 12 to define an acute angle $\alpha$ relative to the reference axis A which is perpendicular to the base 12. The angle $\alpha$ is preferably in the range of 15°–40°. Also, the sidewalls 14–20 are formed to be outwardly bowed as taught in U.S. Pat. No. 5,018,623. The entire disclosure of U.S. Pat. No. 5,018,623 is incorporated by reference herein. Each of the sidewalls 14–20 is formed with an inner surface 36–42, respectively, an outer surface 44–50, respectively, and a top surface 52–58, respectively.

Figure 4:
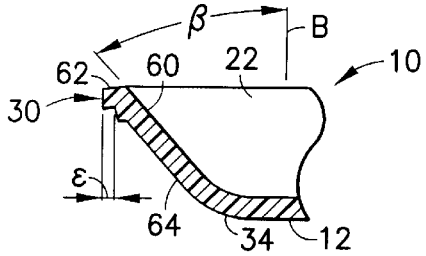
FIG. 4 is a partial cross-sectional view of a comer of the first embodiment of the invention taken along lines 4—4 of FIG. 1.
Figure 9:
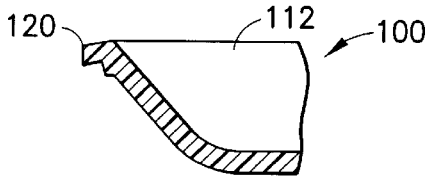
FIG. 9 is a partial cross-sectional view of a comer of the second embodiment of the invention taken along 9—9 of FIG. 6.

The corners 22–28 are also angularly disposed relative to the base 12 as shown in FIG. 4. Preferably, each of the corners 22–28 is generated by rotating a plane curve about a central axis B which is perpendicular to the base 12. The corners 22–28 are preferably formed to define an acute angle $\beta$ relative to the reference axis B in the range of 19°–45°. In forming the tray 10, the corners 22–28 preferably are formed to define a greater acute angle $\beta$ than the acute angle $\alpha$ defined by the sidewalls 14–20. Referring to FIG. 4 as a representative depiction, the comer 22 is formed with an inner surface 60, an outer surface 62, and a top surface 64. Each of the corners 24–28 are formed exactly like the corner 22.

A bead 66 may be provided to extend from the outer surfaces 44–50 of the sidewalls 14–20 and the outer surfaces of the corners 22–28. The bead 66 may be continuous or formed with interruptions and may be formed with an arcuate shape in accordance with the teaching of U.S. Pat. No. 5,018,623. Altematively, as shown in the FIGS., the bead 66 may be formed with a generally planar outer surface 67.

The flange 30 is formed to extend from the outer surfaces 44–50 of the sidewalls 14–20 and the outer surfaces of the corners 22–28. Preferably, the flange 30 extends continuously about the tray 10. Alternatively, the flange 30 may be formed to extend from a pair of opposing sidewalls, such as the longitudinal sidewalls 14, 16 or the end sidewalls 18, 20. Also, preferably the bead 66 is formed adjacent the flange 30, although, the bead 66 may be spaced from the flange 30. The flange 30 has an upper surface 68, a base surface 70, and an edge surface 72. The upper surface 68 extends continuously from the top surface of the adjoining sidewall 14–20 or corner 22–28. The edge surface 72 is spaced from the outer surface 67 of the bead 66 formed on the adjoining sidewall 14–20 or corner 22–28. As can be seen in FIG. 1, the edge surface 72 defines the overall shape of the tray 10.

Figure 2:
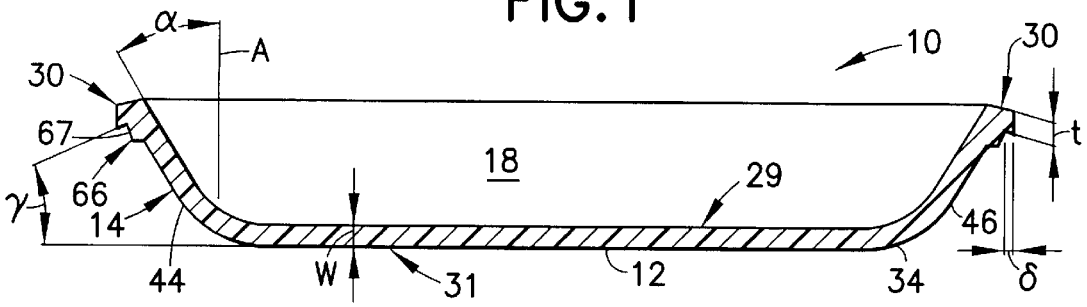
FIG. 2 is a side cross-sectional view of the first embodiment of the invention taken along line 2—2 of FIG. 1.
Figure 3:
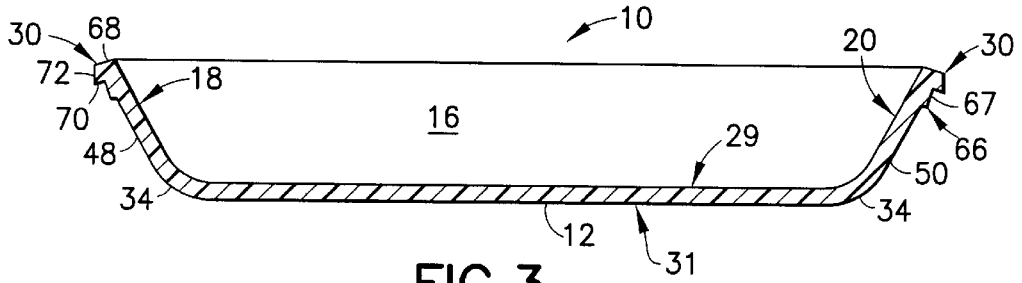
FIG. 3 is a side cross-sectional view of the first embodiment of the invention taken along line 3—3 of FIG. 1.

The flange 30 is angularly disposed relative to the sidewalls 14–20, as shown in FIGS. 2–4, so that the base surface 70 defines an acute angle $\gamma$ relative to the plane of the base 12. Additionally, the upper surface 68 may be formed to define the angle $\gamma$ also. The acute angle $\gamma$ is formed to be in the range of 15°–35°. The upper surface 68 and the base surface 70 may define the same angle. By angularly disposing the flange 30 downwardly, the flange 30 provides spring bias against pressure generated by plastic film. Memory of the plastic foam forming the flange 30 provides "kick back" in reaction to the force of the plastic film.

Additionally, the flange 30 is preferably formed with varying widths about the tray 10. Specifically, referring to FIG. 2, the flange is formed with a width $\delta$ at a central mid-point of the longitudinal sidewall 16. Referring to FIG. 4, the flange 30 defines a width $\epsilon$ adjacent the corner 22. The dimension $\epsilon$ is measured at the point from which the corner 22 is generated about the reference axis B—i.e., the point at which the corner 22 meets the adjoining sidewall 14. The width $\delta$ is greater than the width $\epsilon$. The widths $\delta$ and $\epsilon$ are shown to be measured from the outer surface 67 of the bead 66. If the bead 66 is not provided, the widths $\delta$ and $\epsilon$ are measured from the respective outer surface of the sidewall or corner. As such, the flange 30 has a greater width at the center mid-point of the sidewall 16 than at the comer 22. Preferably, the same dimensioning of the flange 30 is provided for each of the other sidewalls 14, 18 and 20 and each of the other corners 24–28 —i.e. the flange 30 is formed with the width $\delta$ at the respective center mid-points of each of the sidewalls 14, 18 and 20 and with the width $\epsilon$ at the corners 24–28. Intermediate the respective center mid-points of the sidewalls 14–20 and the corners 22–28, the flange 30 is formed with varying widths. The flange 30 may be formed with the edge surface 72 being curvilinear or, altematively, the edge surface 72 can be formed with planar portions. In either case, the flange 30 is to be formed so that the varying width portions are blended together by the edge surface 72 to provide an aesthetically pleasing shape for the tray 10.

Preferably, the flange 30 is formed with varying widths along each of the sidewalls 14–20. Alternatively, the tray 10 may be formed with only a pair of opposing sidewalls, either the longitudinal sidewalls 14, 16 or the end sidewalls 18, 20, with the flange 30 having varying widths. Also, the dimensioning of the flange 30 need not be the same for each of the sidewalls and the corners 22–28. For example, the tray 10 may be formed so that the flange 30 extends further from the longitudinal sidewalls 14, 16 than the end sidewalls 18,20. Finally, the flange 30 need not be provided with the greatest width at the center mid-point; the width of the flange 30 at any point between the corners 22–28 may be greater than at points adjacent the corners 22–28.

Figure 5:
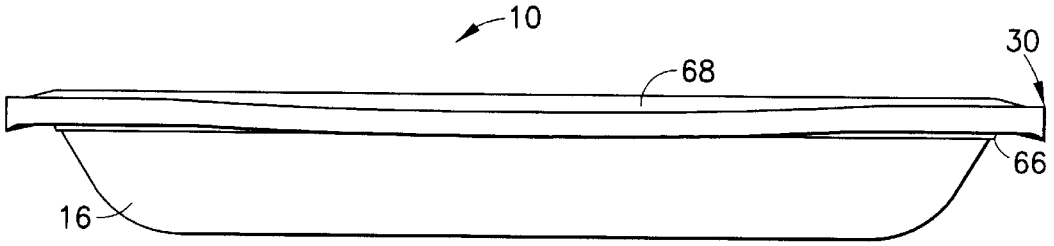
FIG. 5 is a side elevational view of the first embodiment of the invention.

As shown in FIG. 5, due to the flange 30 being angularly disposed and formed with a greater width at a center mid-point of the sidewall, the flange 30 has a curved profile. Also, it is apparent from FIG. 5 that the flange 30 is formed with a substantial thickness as compared to the overall height of the tray 10. In forming the tray 10, it is preferred that the tray 10 be unitarially formed from a single sheet of plastic foam material molded to define the features described herein and cut by the method described in U.S. Pat. No. 4,856,393. Accordingly, the thickness of the flange 30 will be equal to or substantially equal to the thickness of other portions of the tray 10. Referring to FIG. 2, the flange 30 is shown to have a thickness "t", whereas the base 12 is shown to define a thickness of "w". Generally, the thickness "t" will equal the thickness "w". However, during manufacturing the foam material will compress differently at various locations, thus resulting in slight thickness variations in the tray 10.

FIGS. 6–9 are directed to a second embodiment of the processor tray of the subject invention which is generally designated by the reference numeral 100. The same features and considerations set forth above with respect to the first embodiment are equally applicable to the second embodiment. The tray 100 is formed from a plastic foam material and includes a base 102, longitudinal sidewalls 104, 106, end sidewalls 108, 110 and corners 112–118. A flange 120 is formed to extend from uppermost portions of the sidewalls 104–110 and the corners 112–118.

The construction of the tray 100 is similar to that as described above with respect to the first embodiment. In contrast to the first embodiment, the sidewalls 104–110, however, are formed with bowed-in curvature rather then bowed-out curvature as in the first embodiment. A bead 122 may also be formed on the tray 100 in a manner similar to the bead 66 being formed on the tray 10. The angular disposition of the sidewalls 104–110 and the corners 112–118 relative to the base 102 is also the same as in the first embodiment. Finally, the flange 120 may be formed with the same considerations as the flange 30 of the first embodiment.

Figure 6:
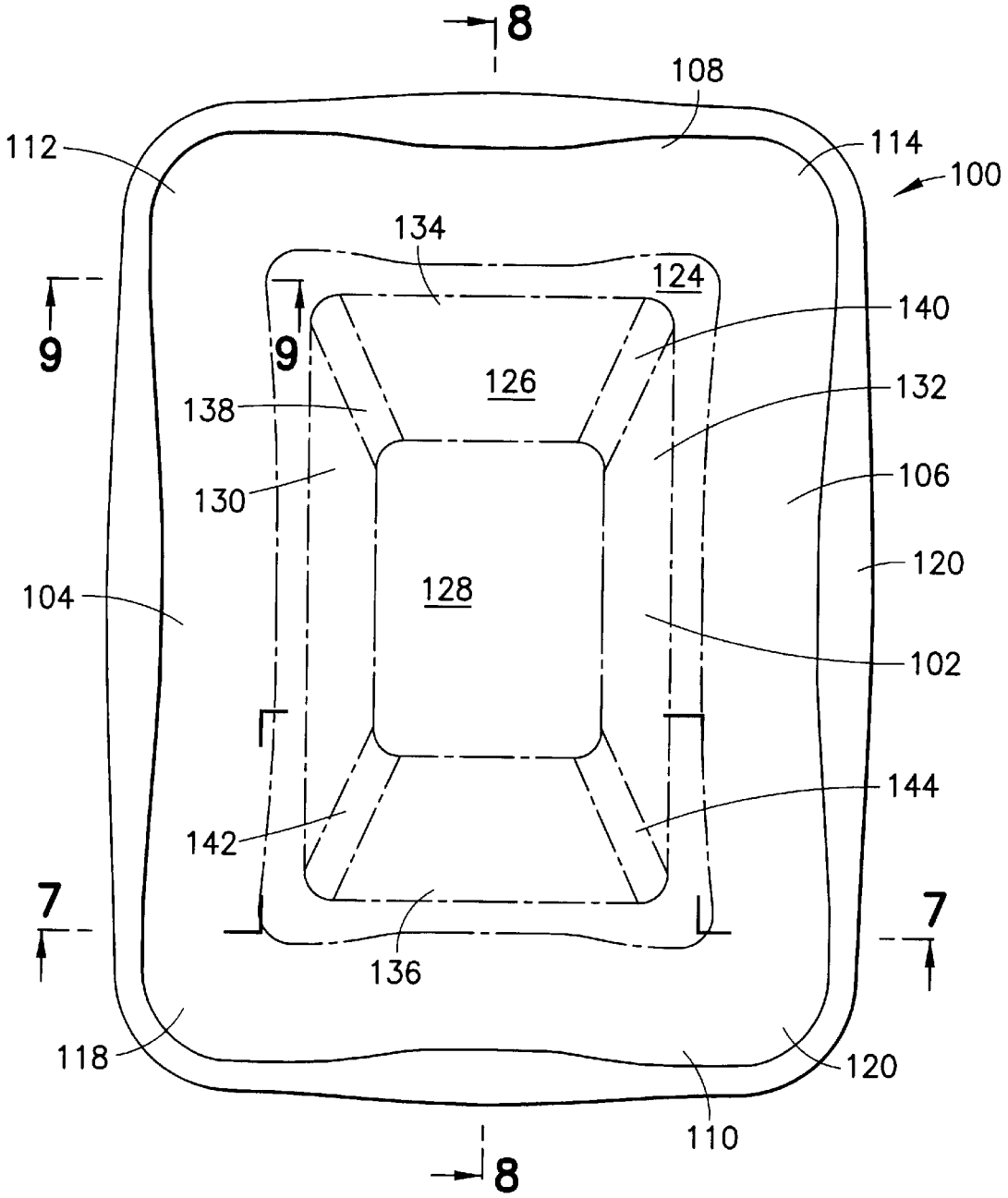
FIG. 6 is a top plan view of the second embodiment of the invention.

With respect to the second embodiment, the base 102 is formed differently from the base 12 of the first embodiment. Specifically, the base 102 includes concentric first, second and third regions, 124, 126, 128 respectively defined in a bottom surface 129 of the base 102, which collectively define a concave void. The base 102 is formed with an inner surface 131 which also defines the shapes of the concentric regions 124–128. For illustrative purposes, the regions 124–128 are shown in FIG. 6 in dash-dot-dash lines. The edges and corners of the regions 124–128 are actually not as apparent in a physical embodiment of the tray. The first region 124 defines the perimeter of the base 102. The third region 128 is centrally located in the base 102 and is planar. The second region 126 is formed with a plurality of flat portions 130–136 which extend between the first and third regions 124 and 128. The second region 126 also includes four rounded corners 138–144 which join the flat portions 130–136.

Figure 8:
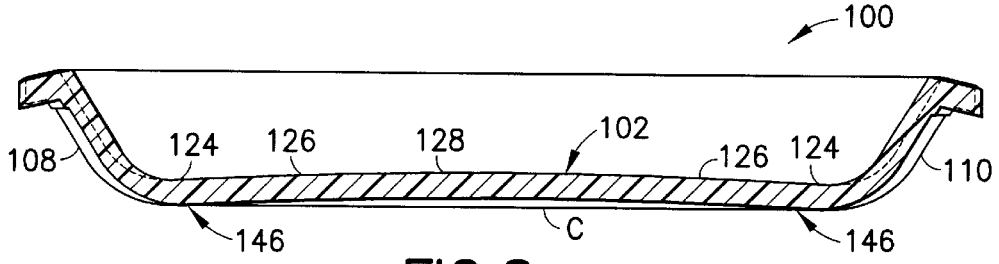
FIG. 8 is a side cross-sectional view ofthe second embodiment of the invention taken along line 8—8 of FIG. 6.
Figure 7:
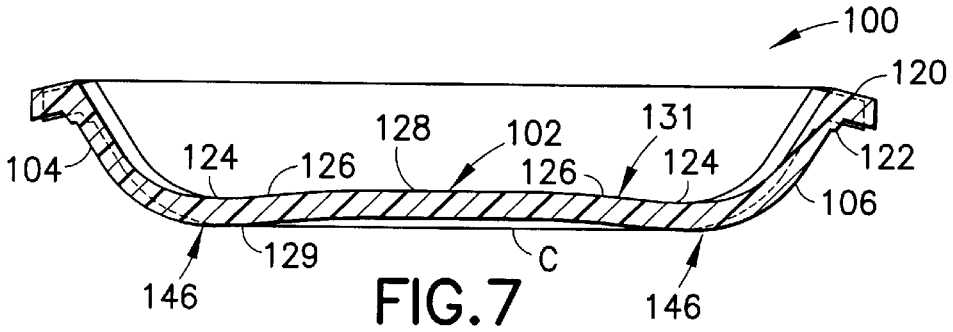
FIG. 7 is a side cross-sectional view of the second embodiment ofthe invention taken along line 7—7 of FIG. 6.

Referring to FIG. 7, the first region 124 is formed with a bottom surface 146 which defines a planar resting surface for the tray 100. The reference line C depicts the plane defined by the bottom surface 146. The third region 128 is formed to be raised relative to the third region 124 so that a concavity is defined above the plane represented by the reference line C and bordered by the bottom surface 146. The third region 128 is raised in a similar fashion along the longitudinal axis of the tray 100, as shown in FIG. 8.

The first region 124 is preferably formed to be planar with the bottom surface 146 being planar. Alternatively, the bottom surface 146 may be formed within an arcuate shape or other shape which would define the resting surface for the tray 100. The third region 128 is preferably formed with a rectangular shape, but may also be formed to define a different shape, e.g. an ellipse. Finally, the second region 126 may be formed with curved portions, rather than the flat portions, 130–136 which extend between the first and third regions 124 and 128.

The formation of the concavity by the base 102 advantageously provides for "spring force" which acts to rigidify the structure of the tray 100 under load. Specifically, when an article is packaged in the tray 100, the third region 128 is forced into the concavity with the base 102 becoming substantially flat. As a result, the material forming the base 102 becomes biaxially stressed in compression. The compressive forces cause the base 102 to be more rigid along with the remainder of the tray 100. Additionally, the use of the shape of the base 102 will minimize or altogether prevent excessive downward deflection of the base 102 under load which can potentially lead to loosening of plastic film. As mentioned above, the configuration of the base 102 may be used with the first embodiment, and conversely, the base 102 of the second embodiment may be formed flat.

A third embodiment of the invention may be formed which is a combination of the first and second embodiments. In the third embodiment, a processor tray may be formed having the bowed-out end sidewalls 18, 20 of the first embodiment and the bowed-in longitudinal sidewalls 104, 106 of the second embodiment. The opposite variation may also be used. Further one pair of opposing sidewalls may be made straight, whereas, the other pair of opposing sidewalls can be formed in accordance with either the first or second embodiment. Also, any of the features described above may be used in any combination.

Figure 10:
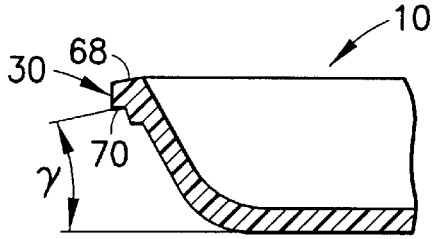
FIG. 10 is a partial cross-sectional view of a modified first embodiment of the invention.
Figure 11:
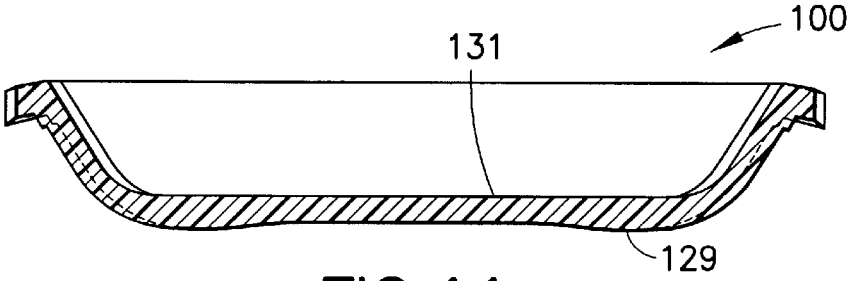
FIG. 11 is a cross-sectional view of a modified second embodiment of the invention.

In addition, the embodiments shown above are formed from molding procedures which utilize matched mating male and female dies. In other words, the inner and outer surfaces of the various elements of the trays are shown to be parallel. The above-described trays, however, may be formed with portions which do not have parallel inner and outer surfaces. By example with reference to the first embodiment, the upper surface 68 of the flange 30 can be formed to define a different angle than the base surface 70, as shown in FIG. 10. In particular, the base surface 70 is formed to define the angle $\gamma$ whereas, the upper surface 68 is formed to define no angle or an insubstantial angle. As a second example, with reference to the second embodiment, the base 102 may be formed with non-parallel surfaces. Referring to FIG. 11, the inner surface 131 of the base 102 may be formed flat with the bottom surface 129 being formed as described above with the concentric regions 125–128. As avariation, the inner surface 131 maybe formed with adome shape.

Figure 12A:
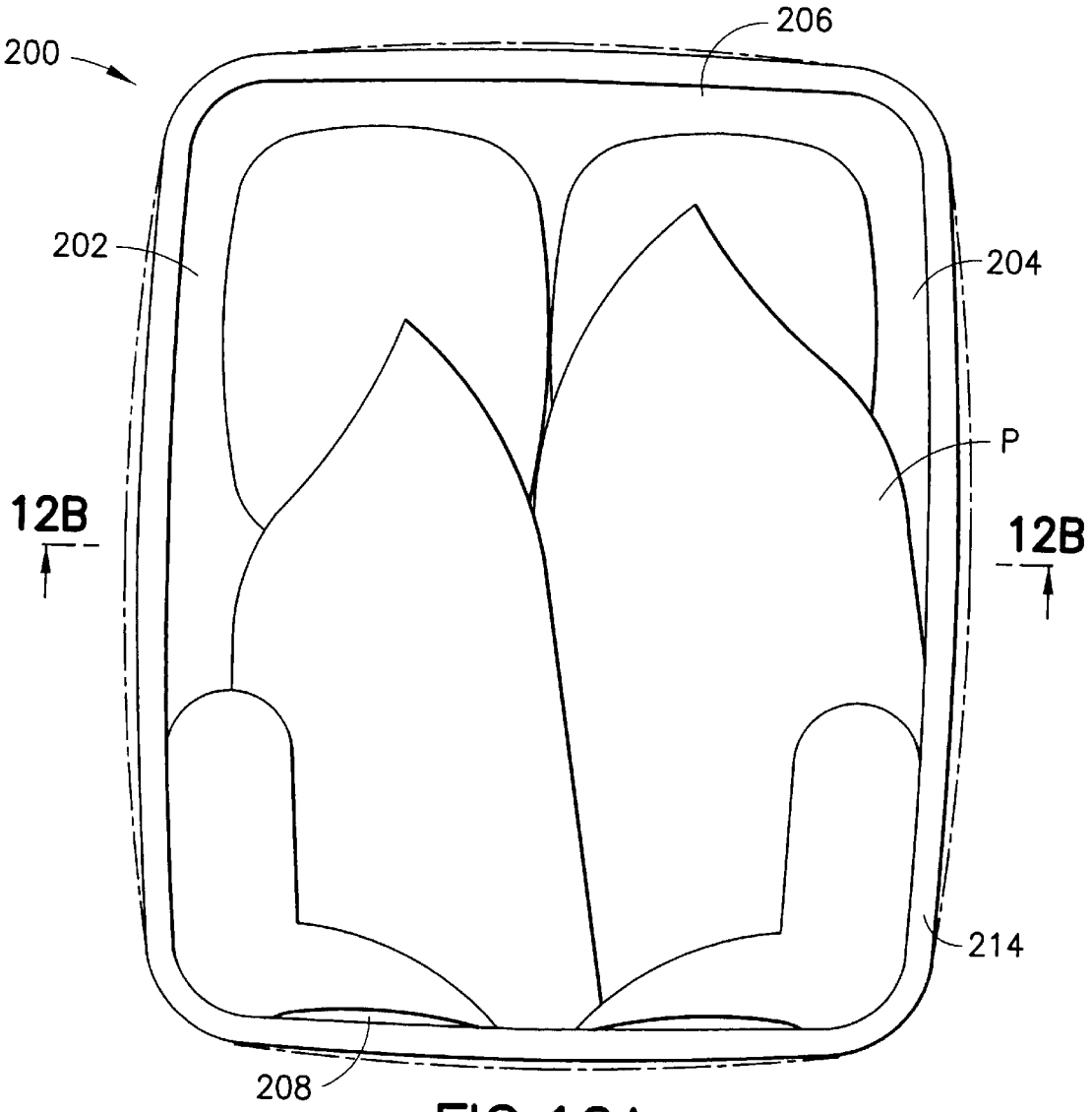
FIGS. 12A and 12B are views of a third embodiment of the invention showing the tray under loading from packaged goods and plastic film wrap.
Figure 12B:
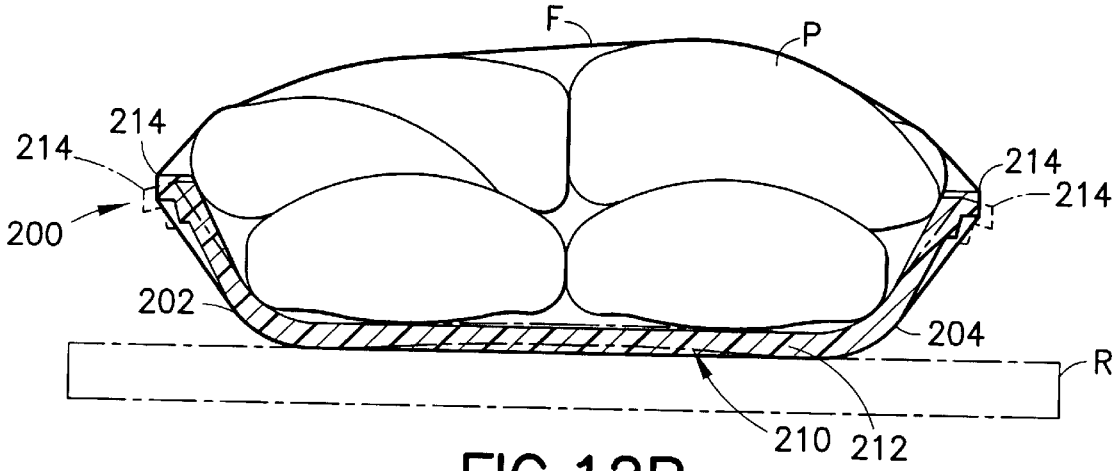

Referring to FIGS. 12A and 12B, a wrapped and packaged tray 200 of the third embodiment is shown therein to graphically demonstrate the deflection of the flange and the bottom under loading from packaged goods P and tightly wrapped plastic film F (shown to be transparent). The tray 200 is formed with sidewalls 202–208 having bow out curvature as in the first embodiment, but also the concavity as in the second embodiment formed in the bottom surface 210 of the base 212. An angularly disposed flange 214 is also provided, with is formed in accordance with the disclosure relative to the flange 30 of the first embodiment. The same deflection shown in the FIGS. 12A and 12B will occur in other embodiments of the invention.

The original unstressed shape of the tray 200 is shown in dash-dot-dash lines, whereas, the loaded shape of the tray 200 is shown in solid lines. As can be seen in FIG. 12B, the sidewalls 202–208 deflect inwardly under the loading of the packaged goods P and the film F. Also, the flange 214 is deflected upwardly to be generally planar. The memory of the plastic foam forming the sidewalls 202–208 and the flange 214 will generate a reactive force pushing outwardly and downwardly against the plastic film F. The reactive force ensures the plastic film F remains in a taut state. It is also appreciated that the initial downward angular disposition of the flange 214 resists the extent of upward deflection of the flange 214. Additionally, the loading of the packaged goods P in the tray 300 will cause the base 212 to deflect downwardly into the concave void originally formed therein. As a result, the bottom surface 210 is generally planar and provides a good surface for stable resting on a surface R with "rocking" of the tray 300 being altogether eliminated or at least greatly minimized.

Figure 13:
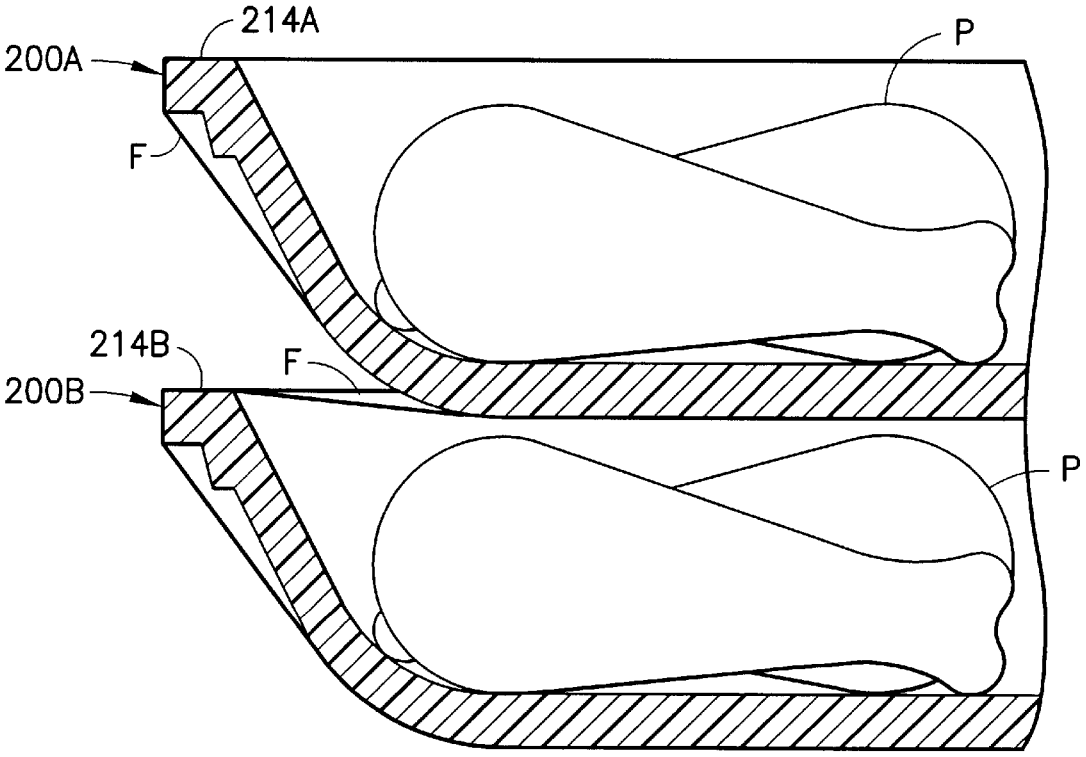
FIG. 13 is a partial cross-sectional view of two trays of the third embodiment of the invention packaged, wrapped, and in a stacked arrangement.

With the plastic film F being maintained in a taut state, the trays of the subject invention can be packaged, wrapped and stacked in a master container for shipment. As shown in FIG. 13, with two of the trays 200A and 200B being stacked, the flanges 214A and 214B, respectively, along with the sidewalls, apply force to the film F to maintain tautness. With the tray 200A resting on the plastic film F of the tray 200B, the plastic film F deflects downwardly with the bottom of the tray 200A being below the top surface of the flange 21413. Although the plastic F may stretch slightly, the plastic film F remains taut and does not become loosened about the tray 200B. The same result is achieved even where the packaged goods P extend from the tray as shown in FIG. 12B. With prior art designs, insufficient outwardly directed forces were generated to maintain the plastic film taut.

As is readily apparent, numerous modifications and changes may readily occur to those skilled in the art, and hence it is not desired to limit the invention to the exact construction and operation as shown and described, and accordingly all suitable modification equivalents may be resorted to falling within the scope of the invention as claimed.

What is claimed is:

1. A plastic foam processor tray for packaging goods, said tray comprising:

a base having an interior surface and an exterior surface, at least a portion of said exterior surface defining a bottom of the tray, said bottom defining a plane;

a plurality of sidewalls integrally formed with and extending from said base, each said sidewall having an inner surface, an outer surface, and a top surface extending therebetween, said inner surface extending continuously from said interior surface of said base;

a plurality of corners, each said corner integrally formed with and extending between a pair of said sidewalls, said corners integrally formed with and extending from said base; and a flange integrally formed with at least one of said sidewalls, said flange having an upper surface, a base surface, and an edge surface extending therebetween, said flange extending from said outer surface of said sidewall adjacent said top surface of said sidewall, said edge surface of said flange being spaced from said outer surface of said sidewall, wherein said flange extends away from said sidewall with said base surface of said flange defining an acute flange angle in the range of 15°–35° relative to the plane defined by the bottom.

2. A processor tray as in claim 1, wherein said upper surface of said flange defining an acute flange angle in the range of 15°–35° relative to the plane defined by the bottom.

3. A processor tray as in claim 2, wherein said base surface and said upper surface define the same acute flange angle.

4. A processor tray as in claim 1, wherein each said sidewall defines an acute first angle relative to a vertical axis perpendicular to said base.

5. A processor tray as in claim 4, wherein each said corner is generated about a central axis, said central axis being perpendicular to said base, said comer being formed to define an acute second angle relative to said central axis, said acute second angle being greater than said acute first angle.

6. A processor tray as in claim 1, wherein said edge surface of said flange is spaced at a first distance from said outer surface of said sidewall at a mid-point of said sidewall, wherein said edge surface of said flange being spaced a second distance from said outer surface of said sidewall at a point adjacent one said comer adjoining said sidewall, said first distance being greater than said second distance.

7. A processor tray as in claim 1, wherein said exterior surface of said base is formed with concentric first, second and third regions, said first region extending about the periphery of said base and being formed to define the bottom of the tray, said second region being planar and located in the center of said base, said second region being raised relative to said first region with said second region being located closer to the top surfaces of said sidewalls than said first region, and said third region extending between and connecting said first and second regions.

8. A processor tray as in claim 7, wherein the plane defined by said second region is generally parallel to the plane defined by the bottom.

9. A processor tray as in claim 7, wherein said second region is formed with a generally rectangular shape.

10. A processor tray as in claim 6, wherein said exterior surface of said base is formed with concentric first, second and third regions, said first region extending about the periphery of said base and being formed to define the bottom of the tray, said second region being planar and located in the center of said base, said second region being raised relative to said first region with said second region being closer to the top surfaces of said sidewalls than said first region, and said third region extending between and connecting said first and second regions.

11. A processor tray as in claim 1, wherein said upper surface of said flange extends continuously from said top surface of said sidewall.

12. A processor tray as in claim 1, wherein said interior surface of said base is spaced from said exterior surface of said base a distance, and wherein said upper surface of said flange is spaced from said base surface of said flange also said distance.

13. A processor tray as in claim 1, wherein at least two of said sidewalls are outwardly bowed.

14. A processor tray as in claim 1, wherein at least two of said sidewalls are inwardly bowed.

15. A plastic foam processor tray for packaging goods, said tray comprising:

a base having an interior surface and an exterior surface, at least a portion of said exterior surface defining a bottom of the tray;

a plurality of sidewalls integrally formed with and extending from said base, each said sidewall having an inner surface, an outer surface and a top surface extending therebetween, said inner surface extending continuously from said interior surface of said base;

a plurality of corners, each said comer integrally formed with and extending between a pair of said sidewalls, said corners integrally formed with and extending from said base, each said comer having an inner surface, an outer surface and a top surface extending therebetween, said inner surface extending continuously from said interior surface of said base; and a flange integrally formed with at least one of said sidewalls and portions of at least one adjoining said comer, said flange having an upper surface, a base surface and an edge surface extending therebetween, said flange extending both from said outer surface of said sidewall and portions of said outer surface of said corner adjacent respectively said top surface of said sidewall and said top surface of said comer, said edge surface of said flange being spaced respectively from said outer surface of said sidewall and said outer surface of said comer, wherein said edge surface of said flange is located at a first distance from said outer surface of said sidewall at a mid-point of said sidewall, said edge surface of said flange being located a second distance from said outer surface of said comer at a point adjacent said comer, said first distance being greater than said second distance.

16. A processor tray as in claim 15, wherein said edge surface of said flange is curvilinearly formed.

17. A processor tray as in claim 15, wherein said edge surface of said flange is formed with planar portions.

18. A processor tray as in claim 15, wherein said exterior surface of said base is formed with concentric first, second and third regions, said first region extendingabout the periphery of said base and being formed to define the bottom of the tray, said second region being planar and located in the center of said base, said second region being raised relative to said first region with said second region being located closer to the top surfaces of said sidewalls than said first region, and said third region extending between and connecting said first and second regions.

19. A plastic foam processor tray for packaging goods, said tray comprising:

a base having an interior surface and an exterior surface, said base also having a perimeter and a center;

a plurality of sidewalls integrally formed with and extending from the perimeter of said base with said sidewalls encircling said interior surface of said base, each said sidewall having a top surface; and a plurality of corners, each said corner integrally formed with and extending between a pair of said sidewalls, said corners integrally formed with and extending from the perimeter of said base, wherein said exterior surface of said base is formed with concentric first, second and third regions, said first region being formed to extend coextensively with the perimeter, said second region being located in the center of said base, said second region being raised relative to said first region such that said second region is closer to said top surfaces of said sidewalls than said first region, and said third region extending between and connecting said first and second regions.

20. A tray as in claim 19, wherein said second region is substantially planar.

21. A tray as in claim 20, wherein said first region is substantially planar.

22. A tray as in claim 21, wherein said second region is substantially parallel to said first region.

23. A tray as in claim 19, wherein said third region has at least one flat portion.

24. A tray as in claim 19, wherein said interior surface of said base is formed with said concentric regions.

25. A tray as in claim 19, wherein said second region is formed with a generally rectangular shape.

26. A processor tray as in claim 15, wherein each sid sidewall defines an acute first angle relative to a vertical axis perpendicular to said base.

27. A processor tray as in claim 26, wherein each said corner is generated about a central axis, said central axis being perpendicular to said base, said corner being formed to define an acute second angle relative to said central axis, said acute second angle being greater than said acute first angle.

28. A processor tray as in claim 15, wherein said upper surface of said flange extends continuously from said top surface of said sidewall.

29. A processor tray as in claim 15, wherein at least two of said sidewalls are outwardly bowed.

30. A processor tray as in claim 15, wherein at least two of said sidewalls are inwardly bowed.

31. A plastic foam processor tray for packaging goods, said tray comprising:

a base having an interior surface and an exterior surface;

a plurality of sidewalls integrally formed with and extending from said base with said sidewalls encircling said interior surface of said base, each said sidewall having a top surface; and a plurality of corners, each said corner integrally formed with and extending between a pair of said sidewalls, said corners integrally formed with and extending from said base, wherein said exterior surface is formed with first and second regions, said first region being raised upwardly relative to said second region such that said first region is closer to said top surfaces of said sidewalls than said second region, wherein said first region is deflectable downwardly in response to loading such that at least portions of said first region become substantially coplanar with said second region under loading.

32. A processor tray as in claim 31, wherein said second region is substantially planar.

33. A processor tray as in claim 32, wherein said first region is substantially planar.

34. A processor tray as in claim 33, wherein said second region is substantially parallel to said first region.

35. A processor tray as in claim 31, wherein said exterior surface is formed with a third region extending between and connecting said first and second regions, said third region having at least one flat portion.

36. A processor tray as in claim 31, wherein said interior surface of said base is formed with said first and second regions.

37. A processor tray as in claim 31, wherein said first region is formed with a generally rectangular shape.

38. A processor tray as in claim 31, wherein said first region is bounded by and continuously extends between a single perimeter.

* * * * *